United States Patent [19]

Walker

[11] Patent Number: 4,908,895

[45] Date of Patent: Mar. 20, 1990

[54] AIR MATTRESS

[76] Inventor: Robert A. Walker, 11010 89th Ave. North, Minneapolis, Minn. 55369

[21] Appl. No.: 325,937

[22] Filed: Mar. 20, 1989

[51] Int. Cl.[4] ..... A47C 27/08

[52] U.S. Cl. ..... 255/453; 5/456; 5/457

[58] Field of Search ..... 5/449, 453, 455–457; 137/223; 441/41

[56] References Cited

U.S. PATENT DOCUMENTS

| | | | |
|---|---|---|---|
| Des. 300,194 | 3/1989 | Walker . | |
| 486,696 | 11/1892 | Curlin . | |
| 1,282,980 | 10/1918 | Takach . | |
| 1,730,752 | 10/1929 | Withers . | |
| 2,000,873 | 5/1935 | Arens . | |
| 2,236,587 | 4/1941 | Williams | 137/223 |
| 2,237,012 | 4/1941 | Sampson . | |
| 2,415,150 | 2/1947 | Stein . | |
| 2,542,781 | 2/1951 | Sawyer . | |
| 2,549,597 | 4/1951 | Harris et al. . | |
| 2,604,641 | 7/1952 | Reed . | |
| 2,614,272 | 10/1952 | Morner . | |
| 2,741,780 | 4/1956 | Kimbrig | 5/457 |
| 2,919,747 | 1/1960 | Post | 5/457 |
| 3,128,480 | 4/1964 | Lineback . | |
| 3,705,429 | 12/1972 | Nail | 5/455 |
| 3,780,388 | 12/1973 | Thomas et al. | 5/457 |
| 3,790,975 | 2/1974 | Phillipp et al. . | |
| 3,867,732 | 2/1975 | Morrell . | |
| 4,225,989 | 10/1980 | Corbett et al. . | |
| 4,306,322 | 12/1981 | Young et al. . | |
| 4,394,784 | 7/1983 | Swenson et al. . | |
| 4,541,135 | 9/1985 | Karpov . | |
| 4,631,767 | 12/1986 | Carr et al. | 5/455 X |
| 4,644,597 | 2/1987 | Walker | 5/455 X |
| 4,682,378 | 7/1987 | Savenije . | |

*Primary Examiner*—Michael F. Trettel

*Attorney, Agent, or Firm*—Burd, Bartz & Gutenkauf

[57] ABSTRACT

An air mattress has top and bottom walls joined to side and end walls with edge seams. A longitudinal web located within the chamber of the air mattress extends between the end walls adjacent to each side wall to form a pair of longitudinal air passages. A plurality of transverse webs located within the chamber extends between the longitudinal webs to form transverse air accommodating passages. The bi-directional air passages and webs reduce uneven areas of the top wall and prevent seal failure and mattress collapse. The mattress is equipped with a one-way air pressure relief valve operable to limit the air pressure in the air mattress to about 1 psi to prevent seam separation and blowout.

14 Claims, 3 Drawing Sheets

AIR MATTRESS

FIELD OF INVENTION

This invention relates to inflatable supports, such mattresses, for use in air beds.

BACKGROUND OF INVENTION

Air mattresses are used with cots and beds to provide yieldable body supports. The air mattresses are air-filled bags having flexible, air impervious sheet members secured together to form one or more longitudinal chambers for accommodating air under pressure. Air mattresses have air inlet tubes that are used with hand-operated pumps, bag pumps, and other sources of air under pressure to inflate the mattresses. Plugs are used to close the tubes after the mattresses are inflated with air. Conventional air mattresses do not have pressure relief valves so that they can be easily over-inflated, causing rupture of the mattress material or the separation of the seams. An over-inflated air mattress is relatively hard and can become misshaped and wobbly.

Walker in U.S. Pat. No. 4,644,597 discloses an air mattress with an air pressure relief valve to prevent over-inflation of the mattress The mattress has transverse webs secured to top and bottom walls and opposite side walls to provide transverse air chambers. The opposite ends of the webs are not secured to the top and bottom walls to provide openings to allow air to flow between the chambers. This eliminates holding of the top and bottom walls longitudinally along the opposite sides thereof so that opposite side portions of the top and bottom walls bulge or deform outwardly when the mattress is filled with air under pressure. This concentrates pulling forces on the ends of the seams that connect the webs to the top and bottom walls. These forces are sufficient to cause the seams to separate with the result of a one or more large transverse humps in the air mattress. When two air mattresses are placed side-by-side to make a double or queen size bed, there are two longitudinal humps or ridges down the middle of the bed and a longitudinal hump along each side of the bed. This is an undesirable feature in an air bed. The air mattress is connected to an air pump operable to supply air to the air mattress through a tube connected to an end of the air mattress. An air pressure relief valve is mounted in the same end as the air inlet tube. The remote end of the air mattress is completely enclosed so that when the air mattress is under a moving or sudden load, such as a person's shifting weight or roll-over weight, the air pressure in the remote end of the air mattress substantially increases. This sudden increase in air pressure in the remote end of the air mattress can cause seam tear and separation and even rupture of the walls of the air mattress.

SUMMARY OF INVENTION

The invention is a fluid accommodating apparatus or mattress providing a support for a body, such as a human body. The mattress preferably accommodates air under pressure, such as 1 psi or less. A pressure relief valve connected to one end of the air mattress is operable to insure that the air pressure within the mattress is maintained below a predetermined value so as not to over-inflate the mattress and thereby prevent seam separation and rupture of the walls of the air mattress. The mattress is adapted to be coupled to an air pump operable to provide a supply of air under pressure to the mattress and allow air to exhaust from the mattress. The mattress has top and bottom walls that are connected together with side walls and end walls to form an enclosed air impervious chamber. The chamber is divided into a plurality of connected transverse and longitudinal air accommodating passages with a plurality of beams or webs. Each web is joined to the top and bottom walls and functions to limit outward expansion of the top and bottom walls. An air inlet tube is secured to the end of the air mattress opposite the pressure relief valve to facilitate the supply of air under pressure into the passages. The tube is an elongated elastic tube having a passage open to the chamber from the air pump to carry air between the air pump and chamber. The tube passage also functions as an expansion chamber to accommodate air when the mattress is subjected to a sudden load thereby reducing the forces on the seams and walls of the mattress.

According to a preferred embodiment of the invention, there is provided an air mattress having flexible top and bottom walls located in spaced relation relative to each other. First and second side walls and end walls are joined to the outer edges of each other and the outer edges of the top and bottom walls to form an enclosed chamber for accommodating air under pressure. An air inlet having a flexible and elastic hose joined to one end of the air mattress is used to carry air from a source of air under pressure, such as an air pump, into the air mattress.

A plurality of transverse sheet beams or webs are secured to the top and bottom walls to maintain the air mattress in a box-like shape. A pair of longitudinal sheet beams or webs are secured to the top and bottom walls between the outer ends of the transverse webs and the side walls of the air mattress. The longitudinal and transverse webs stabilize side to side mattress sway motion and eliminate uneven areas on the top wall of the air mattress. The longitudinal webs eliminate the longitudinal humps that occur when two air mattresses are side by side in a dual air bed system. The longitudinal webs also reinforce the mattress and prevent the transverse webs from tearing or ripping away from the top and bottom walls of the air mattress. The opposite ends of the transverse and longitudinal webs have openings to allow air to flow into and out of the transverse and longitudinal air chambers. The walls and webs can be Nylon fabric and vinyl plastic or cotton fabric and rubber sheet members sealed together. These sheet members are air impervious and form seals that do not tear or rip apart in use. A one-way air pressure relief valve is connected to the end of the air mattress opposite the air inlet to prevent over-inflation of the air mattress. A tubular connector couples the one-way air pressure relief valve to the air mattress so that the valve is separated from the walls of the air mattress. This allows the use of a large low pressure sensitive one-way valve to be used with the air mattress without operational interference from the air mattress. The size of these one-way valves prevents the mounting of the valves within the seams of the air mattress as disclosed by Walker in U.S. Pat. No. 4,644,597. The valve has a body that supports a movable spring-biased valving member operable to allow air to evacuate from within the air mattresses when the pressure exceeds a selected level, such as 1 psi.

DESCRIPTION OF PREFERRED EMBODIMENT

Figure 1:
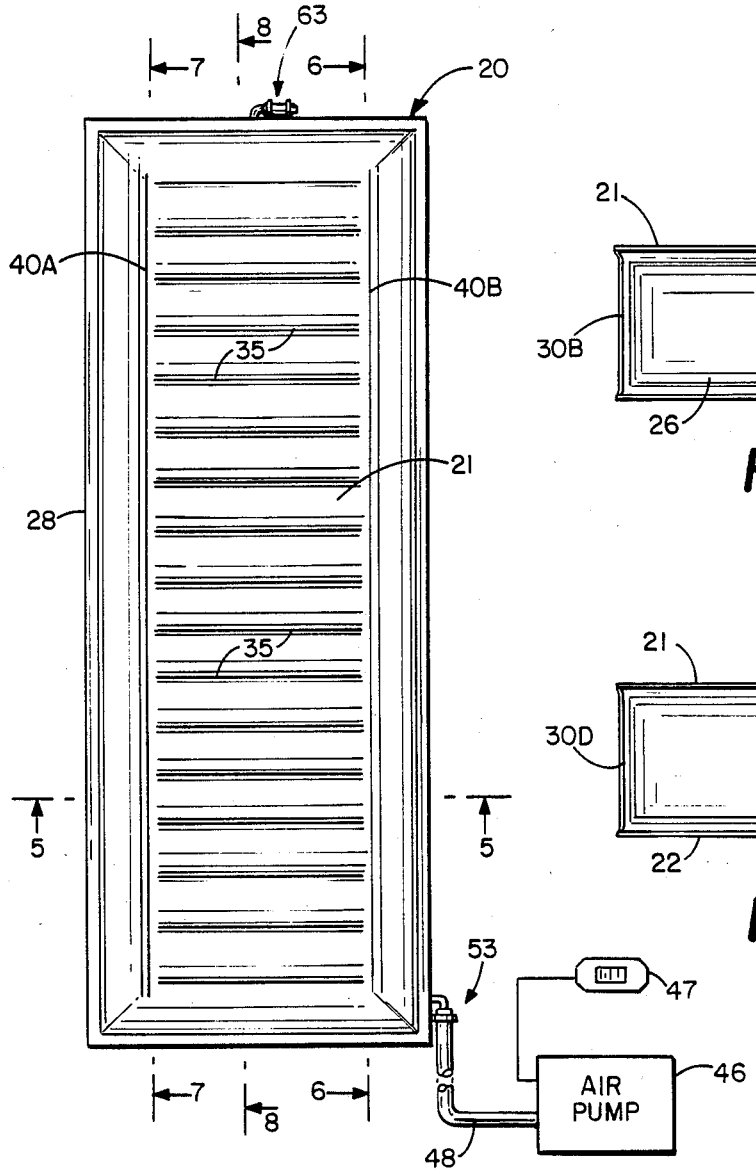
FIG. 1 is a top plan view of the air mattress of the invention connected to an air-pump.
Figure 2:
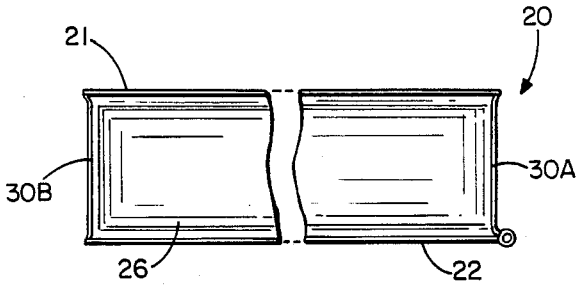
FIG. 2 is a foreshortened end view of the lower end of the air mattress of FIG. 1.
Figure 3:
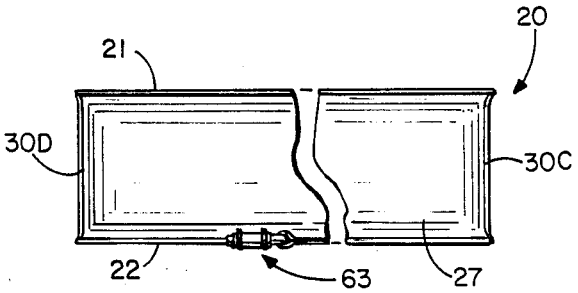
FIG. 3 is a foreshortened end view of the upper end of the air mattress of FIG. 1.
Figure 4:
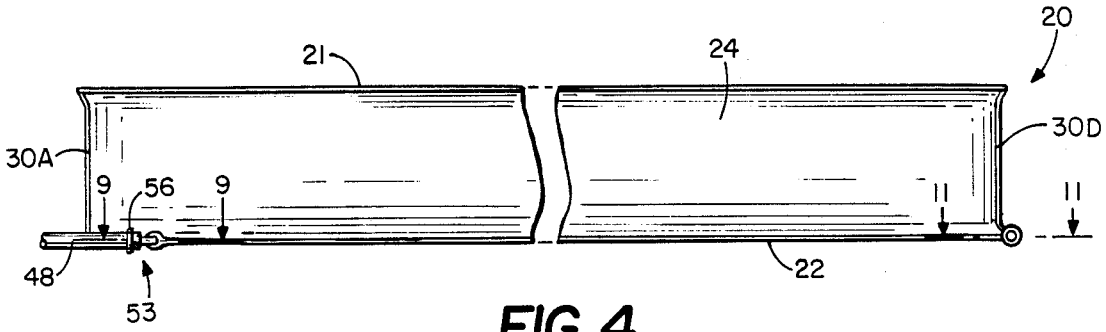
FIG. 4 is a foreshortened side view of the right side of the air mattress of FIG. 1.

Referring to FIGS. 1 to 4, there is shown a fluid accommodating air mattress having an air pressure relief valve of the invention indicated generally at 20 usable to yieldably support an object. Apparatus 20 accommodates a compressible fluid, such as air or other gases, to yieldably support an object in a horizontal position. The apparatus is preferably an air mattress, or bladder used in an air bed to yieldably support one or more prone persons.

Air mattress 20 has a generally rectangular top wall 21 located over a rectangular bottom wall 22. Side walls 23 and 24 and end walls 26 and 27 are secured to the outer peripheral edges of top and bottom walls 21 and 22. Walls 21–24 and 26 and 27 can be a Nylon vinyl, polyester vinyl, Rayon vinyl or cotton rubber. These materials are flexible, strong, and air impervious. They also do not deteriorate over time and are water-resistant. Upper and lower continuous peripheral seals 28 and 29 and corner seals 30A, 30B, 30C and 30D join the adjacent edges of walls 21–24 and 26 and 27. Seals 28, 29, and 30A–30D are fluid impervious continuous connections or seams that permanently join peripheral adjacent portions of walls 21–24 and 26 and 27 together. Seals 28, 29, and 30A–30D are lap seams forming the outer peripheral edges of the air mattress. The seams are formed by know ultrasonic and heat sealing methods.

Figure 5:
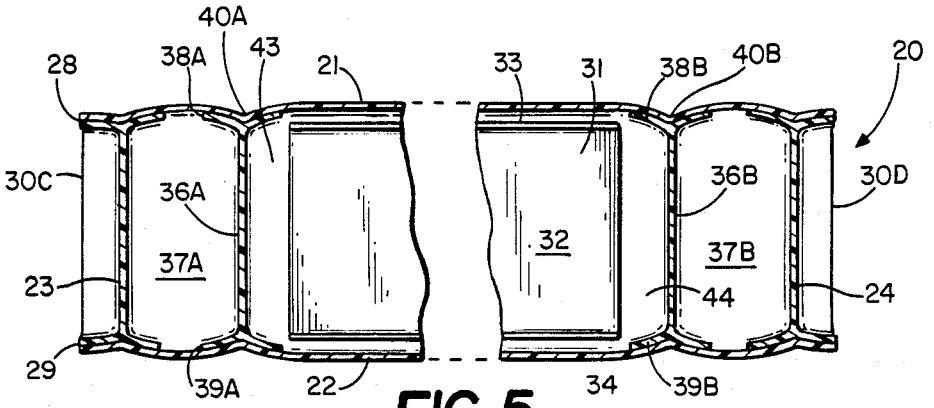
FIG. 5 is an enlarged foreshortened sectional view taken along line 5—5 of FIG. 1.
Figure 8:
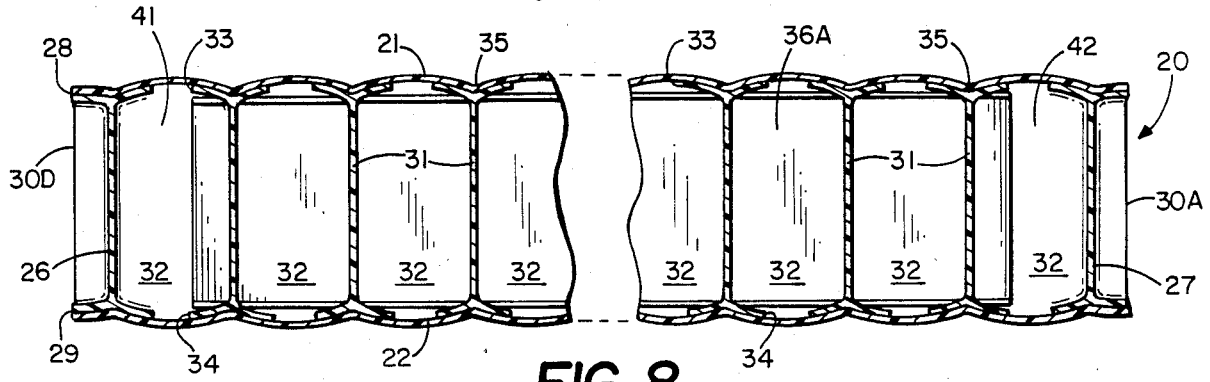
FIG. 8 is an enlarged foreshortened sectional view taken along line 8—8 of FIG. 1.

As shown in FIGS. 5 and 8, a plurality of laterally spaced transverse internal webs or beam supports 31 linearly extend between side walls 23 and 24. Each support 31 has a body or web section and opposite end portions. The upper edges of the web sections of supports 31 have lips 33 that are secured to the inside surface of upper wall 21. The lower portions of the web sections have lower lips 34 that are secured to the inside surface of bottom wall 22. As shown in FIG. 1 and 8, seal seams 35 are utilized to secure lips 33 and 34 to the upper and lower walls 21 and 22. Seal seams 35 extend transversely across top and bottom walls 21 and 22 and are spaced inwardly from adjacent a pair of longitudinal internal webs or beam supports 36A and 36B to provide air passages 43 and 44.

Figure 6:
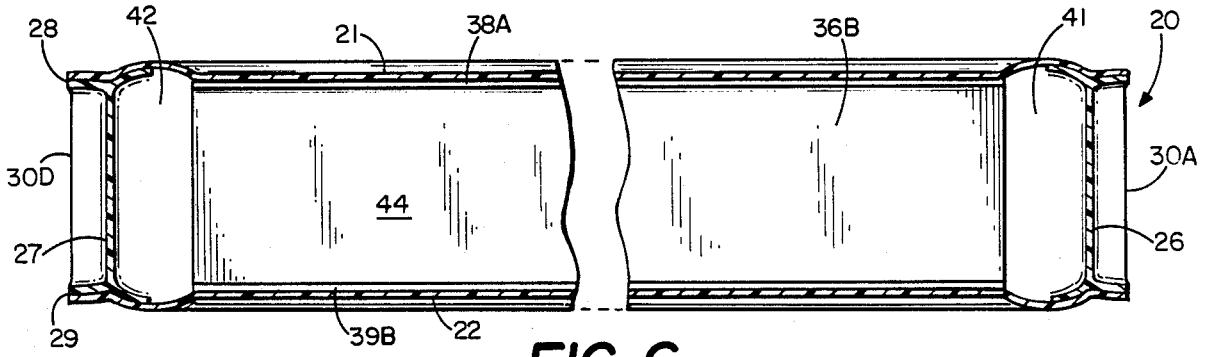
FIG. 6 is an enlarged foreshortened sectional view taken along line 6—6 of FIG. 1.
Figure 7:
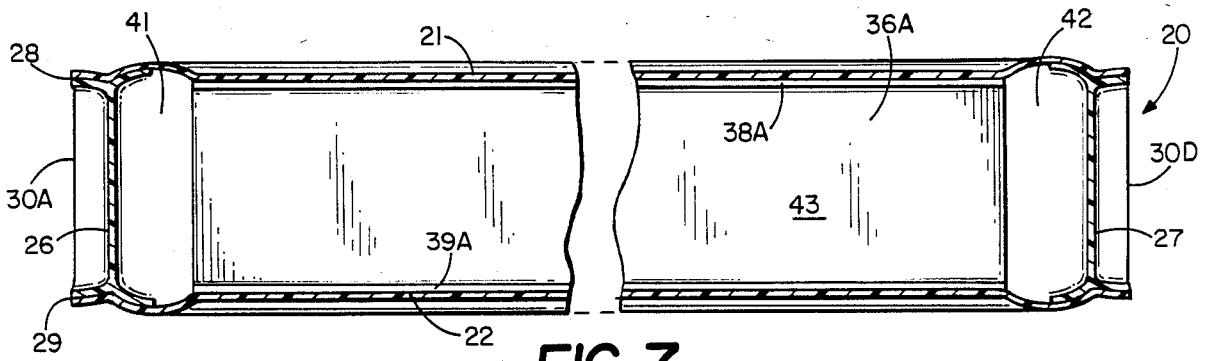
FIG. 7 is an enlarged foreshortened sectional view taken along line 7—7 of FIG. 1.

As shown in FIGS. 6 and 7, supports 36A and 36B extend between end walls 26 and 27. Supports 36A and 36B are similar to supports 31. Each support 36A and 36B has a body or web section and opposite end portions. The upper edges of the web sections of supports 36A and 36B have upper lips 38A and 38B that are secured to the inside surface of upper wall 21. The lower portions of the web sections have lower lips 39A and 39B that are secured to the inside surface of bottom wall 22. Seals 40A and 40B are used to secure lips 38A, 38B and 39A, 39B to the upper and lower walls 21 and 22. The seals 40A and 40B extend longitudinally across top and bottom walls 21 and 22. The end portions of the supports 36A and 36B are spaced inwardly from adjacent end walls 26 and 27 to provide side longitudinal air passages 41 and 42.

Webs 31, 36A and 36B are flexible, non-elastic sheet members that prevent the upper and lower walls 21 and 22 from ballooning or bulging outwardly. Webs 31 divide the interior of air mattress 20 into a plurality of transverse fluid accommodating passages or chambers 32. Chambers 32 extend transversely across apparatus 20 and are located in side-by-side relation between end walls 26 and 27. Webs 36A and 36B separate the transverse chambers 32 from the side walls 23 and 24 and provide a pair of longitudinal air accommodating passages or chambers 37A and 37B. Chambers 37A and 37B extend longitudinally or the length of air mattress 20 and are located between the outer ends of webs 31 and side walls 23 and 24. Air is free to flow in chambers 37A and 37B to minimize differences in air pressure between opposite ends of the air mattress 20.

As shown in FIGS. 1 and 8, transverse webs 31 are equally spaced from each other along the longitudinal dimension or length of air mattress 20. Adjacent webs 31 provide separate transverse air passages or chambers 32. Adjacent webs 31 are preferably laterally spaced about 10 cm. Other lateral dimensions between adjacent webs 31 may be used. Webs 31 vertically reinforce top and bottom walls 21 and 22 and restrict outward expansion or bulging of these walls.

As shown in FIGS. 1 and 5, longitudinal webs 36A and 36B are equally spaced from the side walls 23 and 24 and the outer ends of webs 31 along the length of mattress 20. Webs 36A and 36B provide separate longitudinal air passages 37A and 37B. Webs 36A and 36B are preferably laterally spaced approximately 10 cm. from each side wall 23 and 24 and about 3 cm. from the outer ends of webs 31. Other lateral dimensions between webs 36A and 36B and side walls 23 and 24 and the outer ends of webs 31 may be used. Webs 36A and 36B longitudinally reinforce top and bottom walls 21 and 22 and restrict outward expansion or bulging of opposite side portions of these walls. The bi-directional reinforcement of transverse webs 31 and longitudinal webs 36A and 36B stabilize side-to-side swaying motion of air mattress 20. Webs 36A and 36B also reinforce the seal seams 35 of transverse webs 31 preventing the webs 31 from tearing or ripping away from the top and bottom walls 21 and 22. Webs 36A and 36B also increase the stability of outside walls 23 and 24. The transverse and longitudinal webs 31, 36A and 36B help to eliminate uneven areas on the top wall 21 of air mattress 20. When two air mattresses are used side by side in a dual system (not shown) the longitudinal bumps are eliminated.

Longitudinal webs 36A and 36B also reduce the transfer of motion from one mattress to the other in the dual system.

Referring to FIGS. 5–8, openings 41 and 42 are located between the outer ends of longitudinal webs 36A and 36B and end walls 26 and 27 to permit air to flow into the ends of longitudinal chambers 37A and 37B. Openings 43 and 44 are located between the outer ends of transverse webs 31 and the inside surface of longitudinal webs 36A and 36B to allow air to flow into the end of an adjacent chamber 32. The openings 41 and 42 communicate with openings 43 and 44 whereby air can flow into and out of adjacent chambers 32, 37A and 37B.

Figure 9:
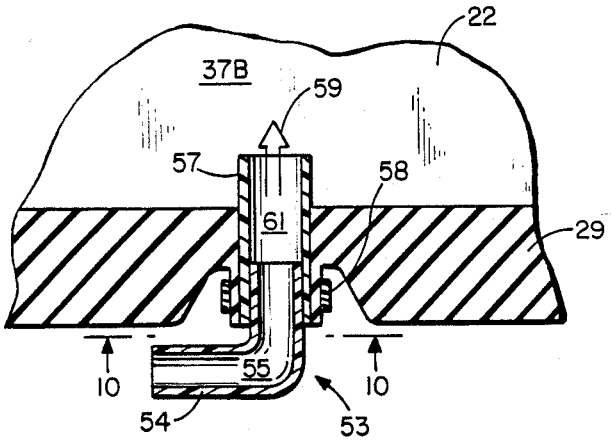
FIG. 9 is an enlarged sectional view taken along line 9—9 of FIG. 4.
Figure 10:
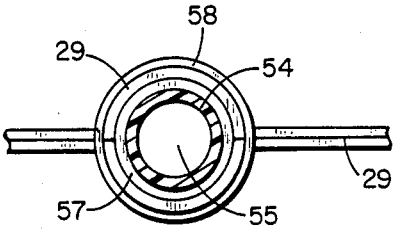
FIG. 10 is an enlarged sectional view taken along line 10—10 of FIG. 9.

Referring to FIGS. 1, 9 and 10, air mattress 20 is connected to an air pump 46 operable to supply the air mattress with air under pressure and allow air to exhaust from the air mattress. The details of air pump 46 are disclosed in U.S. patent application Ser. No. 096,932, incorporated herein by reference. A tube assembly indicated generally at 53 is located in the seam of the lower peripheral seal 29 at one end of air mattress 20. Assembly 53 comprises an L-shaped tube or elbow 54 that telescopes into a short sleeve or tube 57 located in the seam of seal 29. Sleeve 57 is bonded to the material of seal 29. A ring clamp 58 holds in the seam of seal 29 and secures L-tube 54 to sleeve 57. Tube 54 and sleeve 57 have passages 55 and 61 open to chamber 37B and an elongated hose 48. Hose 48 fits over the outer end of L-tube 54 and is secured thereto with a ring clamp 56. The opposite end of hose 48 is attached to the air outlet member of air pump 46. Hose 48 is an elongated flexible and elastic plastic tube having a continuous passage for carrying air between air pump 46 and mattress 20. The air under pressure is also stored within the tube passage when air mattress 20 is inflated. The hose 48 functions as an air accumulator when the air pressure suddenly increases within air mattress 20. The air pump 46 has an electric motor (not shown) that is coupled to a source of electric power. A remote hand operated switch 47 is used to control the operation of the electric motor. The motor drives a fan or impeller that moves air under pressure to hose 48, tube 54 and sleeve 57, and into air mattress chamber 37B as shown by arrow 59. A person lying on the air mattress 20 can utilize switch 47 to operate air pump 46 to increase the pressure to the air in the air mattress or cause the air in the mattress to be evacuated to the atmosphere thereby adjusting the firmness of the air mattress.

An air control system for an air bed is disclosed in copending U.S. Applications Ser. No. 096,932, incorporated herein by reference. This air control system has a pump and hand-operated switches for regulating valves and the pump to supply air to air mattresses. The air control system can be used to supply air to air mattress 20.

Figure 11:
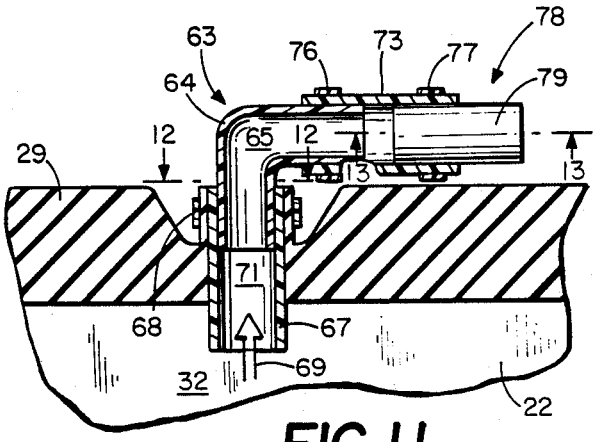
FIG. 11 an enlarged sectional view taken along line 11—11 of FIG. 4.
Figure 12:
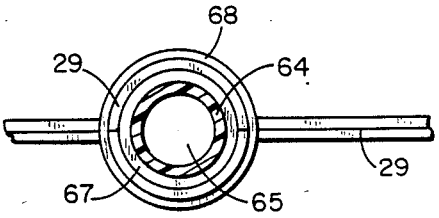
FIG. 12 is an enlarged sectional view taken along line 12—12 of FIG. 11.

Referring to FIGS. 1, 11 and 12, a second tube assembly indicated generally at 63 is connected to lower peripheral seal 29 at the foot of air mattress 20. Tube assembly 63 is at one end of air mattress 20 while tube assembly 53 is at the other or opposite end of air mattress 20. Assembly 63 is used as an outlet passageway to allow air to flow out of mattress chambers 32, 37A and 37B. Assembly 63 has an L-shaped tube or elbow 64 that telescopes into a short sleeve or tube 67 located within the seam of seal 29. Sleeve 67 is bonded to the material of seal 29. Elbow 64 has a small diameter end that fits into sleeve 67 and a large diameter end that supports nipple 73. A ring clamp 68 secures L-tube 64 to sleeve 67. Tube 64 and sleeve 67 have passages 65 and 71 open to chamber 32 and a sleeve or plastic nipple 73. Nipple 73 fits over the outer end of L-tube 64 and is secured thereto with a ring clamp 76. The opposite end of nipple 73 telescopes over a body 79 of a one-way air pressure relief valve, indicated generally at 78. A ring clamp 77 holds sleeve 73 on pressure relief valve 78. The L-tube 64 locates air pressure relief valve 78 adjacent the outside of and generally parallel to end wall 27.

Figure 13:
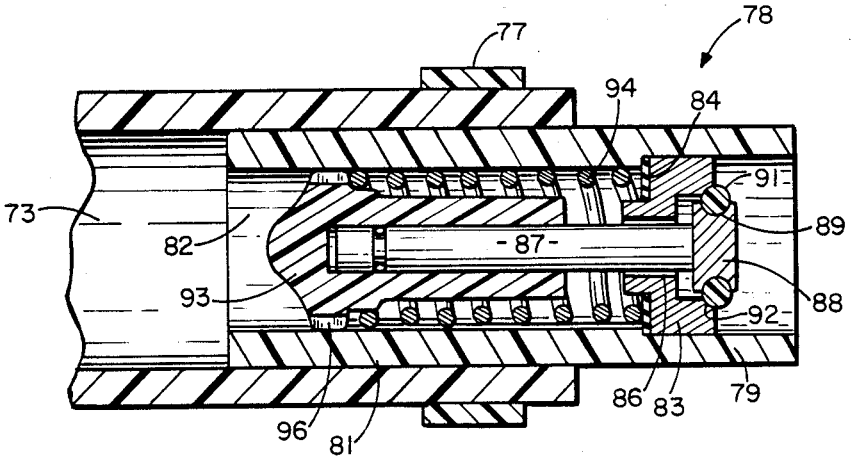
FIG. 13 an enlarged sectional view taken along line 13—13 of FIG. 11.

As shown in FIGS. 11 and 13, pressure relief valve 78 is located within the outer end of nipple 73. Valve 78 operates under all positions of mattress 20 to maintain a predetermined maximum air pressure in air mattress chambers 32, 37A and 37B. Valve 78 prevents over-inflation of air mattress 20, which can cause wall rupture and seal and seam separation. Preferably, the maximum air pressure is about 1 psi. An air pressure exceeding 1 psi will open the pressure relief valve 78 allowing air to exhaust from air mattress chamber 32 through tubes 64, 67, nipple 73, and to the atmosphere thereby relieving the pressure of the air within chambers 32, 37A and 37B. Air pressure relief valves operable to open in response to air pressures below 1 psi can be used with air mattress 20. Air pump 46 is used to supply air under pressure to the mattress. Hand control 47 is used to control the air pump 46 thereby regulating the supply of air to and exhaust of air from the mattress and the pressure of the air within the mattress. When the air pressure within the mattress drops below the maximum value, such as 1 psi, valve 78 will automatically close. Valve 78 prevents over-inflation of air mattress 20 and seam and seal separation and bursting of mattress walls 21–24, 26 and 27 due to sudden pressure shocks imparted to air mattress 20.

Pressure relief valve 78 has a cylindrical plastic body 79 having a cylindrical outside surface 81. Surface 81 is held within sleeve 73 with ring clamp 77. Body 79 has a linear passage 82 accommodating a plug 83. Plug 83 fits into the outer end of passage 82 with a friction fit and holds an annular seal 84 in engagement with the inside of body 79. Plug 83 has a central hole 86 accommodating a linear rod 87. Rod 87 has at its outer end a cylindrical head 88 having an outer peripheral groove 89. An 0-ring 91 fits into groove 89 and engages an annular inclined seat 92 surrounding the outer end of hole 86. Seat 92 is in an outer annular portion of plug 83. Rod 87 extends through hole 86 toward mattress chamber 32. A cup member 93 is snapped onto the inner end of rod 82. Cup member 93 has a plurality of circumferentially spaced ears 96 which allow air to flow past cup member 93 through passage 82. A coil spring 94 is interposed between ears 96 and seal 84 to continuously bias the O-ring 91 into sealing engagement with annular seat 92.

When the pressure of the air in the mattress chamber 32 exceeds the biasing force of spring 94, head 88 will move outwardly thereby moving 0-ring 91 away from seat 92 opening passage 82. The air flows past head 88 to the atmosphere relieving the pressure of the air in the chamber 32. Valve 78 automatically prevents over-inflation of the air mattress and the separation of the seams and the blow-out or bursting of the walls 21, 22, 23, 24, 26 and 27. Sudden pressure shocks to the mattress 20 are vented out of pressure relief valve 78. Head 88 is always located within passage 82 of tube 79 so that outside structures, such as mattress covers, bed frames, and the like do not interfere with the operation of the valve. The pressure relief characteristic of valve 78 is determined by selecting the biasing force of spring 94 to provide a desired maximum pressure of the air in chamber 32. For example, when the biasing force of spring 94 is equal to 1 psi the valve 78 will open when the pressure of the air in chamber 32 exceeds 1 psi.

Examples of air mattresses are as follows: The air mattresses are made in different sizes, i.e., twin, full, queen, and king. These mattresses have a width from 39 inches (99cm) to 84 inches (213 cm). The mattress has a thickness of 6 ½ inches (16 cm), transverse internal web space 4 inches (10 cm) apart along the length thereof and longitudinal internal web space 4 inches (10 cm) apart from the side walls 23 and 24. The walls and webs are made of Nylon vinyl sheet material. An ultrasonic sealing and vulcanization processes are used to make the airtight seams and seals. The air mattress has a high degree of stability, as the air moves transversely in passages 32 when a body rests on top wall 21. Only a controlled restricted amount of air moves longitudinally and laterally due to the stabilization of the mattress from the bi-directional webs 32, 36A and 36B. The air mattress has a rectangular box shape with generally flat sides and ends. The air mattress fits in the dish support of an air bed. Two air mattresses can be used side by side in a dual system. The longitudinal and transverse mattress chambers 32, 37A and 37B help to eliminate any uneven areas on top wall 21 of the air mattress when two mattress units are used in a side by side dual system. The transfer of motion between the mattresses is reduced since the mattress webs run in two perpendicular directions and thereby restrict the lateral and longitudinal movement of the air within the mattress. An air pressure relief valve is connected to an end wall of the air mattress with elbow 64 and nipple 73 to prevent over-inflation of the air mattress.

While there has been shown and described the preferred embodiment of the air mattress with pressure relief valve, it is understood that changes in materials, size, shape, and arrangement of structure may be made by those skilled in the art without departing from the invention. The invention is defined in the following claims.

I claim:

1. An air mattress accommodating air under pressure for providing support for a body comprising: a top wall, a bottom wall spaced from and located below the top wall, side walls and end walls secured to said top and bottom walls, all of said walls comprising flexible air impervious sheet members sealed together along the edge portions thereof to form a chamber for accommodating air under pressure, seam means securing adjacent portions of the sheet members together, a pair of longitudinal first support means located in said chamber extended between said end walls adjacent the side walls and secured to said top and bottom walls providing longitudinal passages accommodating air, a plurality of transverse second support means located in said chamber extended between said pair of first support means and secured to said top and bottom walls providing transverse passages for accommodating air, said first and second support means limiting outward expansion of the top and bottom walls when air under pressure is stored in said chamber; each of said first and second support means having a continuous web section and opposite end portions, an opening adjacent each of said end portions allowing air communication between said transverse and longitudinal passages, the opposite end portions of said first support means longitudinally spaced from said end walls, and the opposite end portions of said second support means laterally spaced from the web sections of the first support means to provide said openings, first tube means mounted in the seam means in one end of the air mattress to facilitate supplying air under pressure to said chamber, an elongated flexible and elastic tube connected to the first tube means and adapted to be connected to a supply of air under pressure to selectively carry air under pressure to said chamber and retain air under pressure within said tube, and second tube means mounted in the seam means in a second end of the air mattress, and air pressure relief valve means connected to said second tube means in communication with said chamber and atmosphere whereby air is vented from said chamber through said valve means when the pressure of the air within the chamber exceeds a selected maximum limit.

2. The air mattress of claim 1 wherein: the first support means extend parallel and adjacent to the side walls.

3. The air mattress of claim 1 wherein: the second support means extend normal to the first support means.

4. The air mattress of claim 1 including: tubular elbow means having a first portion connected to the second tube means and a second portion connected to said air pressure relief valve means.

5. The air mattress of claim 1 wherein: the second tube means is located within the seam means in one end wall of the air mattress, and tubular means connected to the second tube means and air pressure relief valve means to locate the air pressure relief valve means generally parallel to said one end wall.

6. The air mattress of claim 5 wherein: the tubular means is an L-shaped elbow.

7. An air mattress accommodating air under pressure for providing a body support comprising: a first wall, a second wall spaced from the first wall, first and second side walls and end walls secured to said first and second walls to form a chamber for accommodating air under pressure, all of said walls comprising flexible air impervious sheet members, edge means securing said walls together to enclose said chamber, first longitudinal support means located in said chamber extended between said end walls and located adjacent said first side wall, said first longitudinal support means being secured to said first and second walls providing a longitudinal passage accommodating air, second longitudinal support means located in said chamber extended between said end walls and located adjacent said second side wall, said second longitudinal support means being secured to said first and second walls providing with said second side wall a longitudinal passage accommodating air, a plurality of transverse third support means located in said chamber extended between said first and second support means and secured to said first and second walls providing transverse passages for accommodating air, said first, second, and third support means limiting outward expansion of the first and second walls when air under pressure is stored in said chamber thereby reducing uneven areas of the first and second walls, each first, second, and third support means having a continuous web section and opposite end portions, said opposite end portions having openings adjacent thereto providing air communication between adjacent passages for accommodating air under pressure, said opposite end portions of said first and second support means longitudinally spaced from said end walls, and said opposite end portions of said third support means laterally spaced from the web sections of the first and second support means to provide said openings, and means mounted on one of said walls to facilitate supplying air under pressure to said chamber.

8. The air mattress of claim 7 wherein: the first and second support means extend parallel and adjacent to the first and second side walls.

9. The air mattress of claim 8 wherein: the third support means extend normal to the first and second support means.

10. The air mattress of claim 7 including: air pressure relief valve means operable to limit the air pressure in said chamber by venting air from said chamber when the pressure of the air within the chamber exceeds a selected maximum limit, and tubular means connecting the valve means to one of said end walls.

11. The air mattress of claim 10 wherein: said tubular means includes a tubular elbow connected to said one of said walls and said valve means to locate the valve means generally parallel to said one of said walls.

12. An air mattress comprising: a first wall, a second wall, side walls joined to adjacent opposite side edges of the first and second walls, end walls joined to adjacent opposite end edges of said first and second walls and the side walls, all of the walls connected together to form an enclosed chamber for accommodating air under pressure, a plurality of continuous webs located within said chamber including first longitudinal webs located adjacent said side walls and second transverse webs extended between said first longitudinal webs forming a plurality of longitudinal and transverse air accommodating passages, means securing said webs to said first and second walls whereby said webs concurrently limit outward expansion and reduce uneven areas of said first and second walls when air under pressure is stored in said chamber, said first longitudinal webs extended parallel and adjacent to the side walls, said second transverse webs extended normal to the first longitudinal webs, each of said webs having opposite end portions having openings providing air communication between adjacent passages for accommodating air under pressure, the opposite end portions of the first longitudinal webs longitudinally spaced from said end walls, and the opposite end portions of the second transverse webs laterally spaced from the first longitudinal webs to provide said openings, and means mounted on one of said walls usable to supply air to said chamber.

13. The air mattress of claim 12 including: air pressure relief valve means operable to limit the air pressure in said chamber by venting air from said chamber when the pressure of the air within the chamber exceeds a selected maximum limit, and tubular means connecting the valve means to one of said end walls.

14. The air mattress of claim 13 wherein: said tubular means includes a tubular elbow connected to said one of said walls and said valve means to locate the valve means generally parallel to said one of said walls.

* * * * *